US009463473B2

(12) United States Patent
Mackel et al.

(10) Patent No.: US 9,463,473 B2
(45) Date of Patent: Oct. 11, 2016

(54) PHASE-SEPARATION METHOD FOR A PRODUCT, USING A CENTRIFUGE

(75) Inventors: Wilfried Mackel, Lippetal-Herzfeld (DE); Klaus-Peter Eickoff, Rheda-Wiedenbruck (DE)

(73) Assignee: GEA Mechanical Equipment GmbH, Oelde (DE)

( * ) Notice: Subject to any disclaimer, the term of this patent is extended or adjusted under 35 U.S.C. 154(b) by 396 days.

(21) Appl. No.: 13/878,675

(22) PCT Filed: Oct. 10, 2011

(86) PCT No.: PCT/EP2011/067640

§ 371 (c)(1),
(2), (4) Date: Nov. 4, 2013

(87) PCT Pub. No.: WO2012/049119

PCT Pub. Date: Apr. 19, 2012

(65) Prior Publication Data

US 2014/0051563 A1 Feb. 20, 2014

(30) Foreign Application Priority Data

Oct. 14, 2010 (DE) ..... 10 2010 038 195

(51) Int. Cl.

| | |
|---|---|
| ***B04B 1/14*** | (2006.01) |
| ***B04B 11/04*** | (2006.01) |
| ***B04B 11/02*** | (2006.01) |
| ***B04B 11/08*** | (2006.01) |

(52) U.S. Cl.

CPC ..... *B04B 11/02* (2013.01); *B04B 1/14* (2013.01); *B04B 11/04* (2013.01); *B04B 11/082* (2013.01)

(58) Field of Classification Search

CPC ..... B04B 1/12; B04B 1/14; B04B 11/02; B04B 11/04; B04B 11/08; B04B 11/082

USPC ..... 494/3, 37, 56, 57, 67, 70, 72, 74, 75, 79

See application file for complete search history.

(56) References Cited

U.S. PATENT DOCUMENTS

| | | | | |
|---|---|---|---|---|
| 6,976,948 | B1 * | 12/2005 | Hamblad | 494/37 |
| 2009/0298666 | A1 * | 12/2009 | Trager et al. | 494/10 |

FOREIGN PATENT DOCUMENTS

| | | |
|---|---|---|
| DE | 697 12 569 | 10/2002 |
| DE | 10 2005 021 331 | 11/2006 |

(Continued)

OTHER PUBLICATIONS

German Search Report for Application No. 10 2010 038 195.0, dated Jul. 26, 2011.

*Primary Examiner* — Charles Cooley
*Assistant Examiner* — Shuyi S Liu
(74) *Attorney, Agent, or Firm* — Crowell & Moring LLP

(57) ABSTRACT

A method for processing a product provides phase separation into two liquid phases and a solids phase. The method includes processing the product in a continuously operating centrifuge arranged as a separator including a rotatable drum having a vertical rotational axis, discharging a lighter liquid phase continuously from the drum, and discharging a heavier liquid phase discontinuously from the drum. The separator has a disk stack having risers arranged in the drum, a product feed tube, a first separation disk for discharging the lighter liquid phase, a second separator disk for discharging the heavier liquid phase, solids discharge openings for discharging the solids phase from the drum, and a separation zone formed between the lighter liquid phase and the heavier liquid phase in the separator.

8 Claims, 2 Drawing Sheets

(56) References Cited

FOREIGN PATENT DOCUMENTS

| | | | | | |
|---|---|---|---|---|---|
| RU | 2 283 698 C2 | | 9/2006 | | |
| WO | 86/01436 | | 3/1986 | | |
| WO | WO 8601436 | * | 3/1986 | ..... | B04B 1/14 |
| WO | 94/06565 | | 3/1994 | | |
| WO | WO 2007131515 A1 | * | 11/2007 | ..... | B04B 1/08 |

* cited by examiner

PHASE-SEPARATION METHOD FOR A PRODUCT, USING A CENTRIFUGE

CROSS-REFERENCE TO RELATED APPLICATION

This application is a national stage of International Application PCT/EP2011/067640, filed Oct. 10, 2011, and claims benefit of and priority to German Patent Application No. 10 2010 038 195.0, filed Oct. 14, 2010, the content of which Applications are incorporated by reference herein.

BACKGROUND AND SUMMARY

The present disclosure relates to a method for processing a product by phase separation. The present disclosure thus relates to a method for processing a product by phase separation into two liquid phases and a solids phase. The method step includes processing the product, the processing occurring in a continuously operating centrifuge arranged as a separator, the separator including a rotatable drum having a vertical rotational axis, a disk stack having risers arranged in the drum, a product feed tube, a first separation disk for discharging a lighter liquid phase, a second separator disk for discharging a heavier liquid phase, solids discharge openings for discharging a solids phase from the drum, and a separation zone formed between the lighter liquid phase and the heavier liquid phase in the separator.

DE 10 2005 021 331 A1, DE 697 12 569 T2 and WO 94/06 565 A1 are mentioned concerning the technological background. DE 10 2005 021 331 A1 shows a purifier, but the discharge of a heavier liquid phase occurs by an outlet to which a throttle device is assigned and only the discharge of a lighter liquid phase occurs by a separation disk. WO 94/06 565 A1 discloses a purifier in which the lighter liquid phase occurs by a separation disk and the other heavier liquid phase occurs by a discharge apparatus using small tubes that are obliquely adjustable in relation to the radial, which small tubes are set once to the desired radius, so that the discharge of this phase will always occur in operation, but such that only a part of the small tubes immerses into the heavy phase, which is intended to keep friction at a low level. DE 697 12 569 T2 discloses a purifier in which the lighter liquid phase occurs by a baffle plate and the other heavier liquid phase by an outlet element which is pressed by a drive apparatus to varying locations of a free liquid surface area, so that the discharge of this phase will also always occur in operation, wherein the immersion depth in this phase shall be kept constant to the highest possible extent in order to reduce power consumption.

In the operation of purifiers, problems with the continuous discharge of the heavier phase will occur especially when the fraction of the heavier phase relative to the lighter phase is very low, that is, when the fraction of the heavier phase in the incoming product is less than 3%, or, for example, less than 1%.

The embodiments of the present disclosure address the solving of the above-noted problems in a simple way.

Thus, embodiments of the present disclosure relate to a method for processing a product by phase separation into two liquid phases and a solids phase. The method steps include processing the product, the processing occurring in a continuously operating centrifuge arranged as a separation, the separator including a rotatable drum having a vertical rotational axis, a disk stack having risers arranged in the drum, a product feed tube, a first separation disk for discharging a larger liquid phase, a second separator disk for discharging a heavier liquid phase, solids discharge openings for discharging a solids phase from the drum, and a separation zone formed between the lighter liquid phase and the heavier liquid phase in the separator, and, discharging the lighter liquid phase continuously and the heavier liquid phase discontinuously from the drum. Thus, the heavier liquid phase HP and the solid phase will be discharged only discontinuously, whereas the lighter liquid phase LP will be guided continuously from the drum.

As a result, a sufficient quantity of the heavier phase can accumulate at first further outside in the drum during operation until it is possible to discharge this quantity of the heavier phase from the drum. The discharge will then be interrupted for a specific period of time until a sufficient quantity of the heavier liquid phase has accumulated toward the outside in the drum in order to discharge it from the drum. In addition, the solids phase can also be ejected discontinuously from the drum, for example, in a manner which is independent of the time of the discharge of the heavier liquid phase, that is, by the solids discharge openings which are displaceable by a piston slide valve.

The method in accordance with the embodiments of the present disclosure can be used advantageously in the processing of vegetable or animal oils and fats which have a relatively low fraction of heavier phase, for example, less than 3%.

Embodiments of the present disclosure are discussed herein and in the appended claims.

Other aspects of the present disclosure will become apparent from the following descriptions when considered in conjunction with the accompanying drawings.

DETAILED DESCRIPTION

Figure 1:
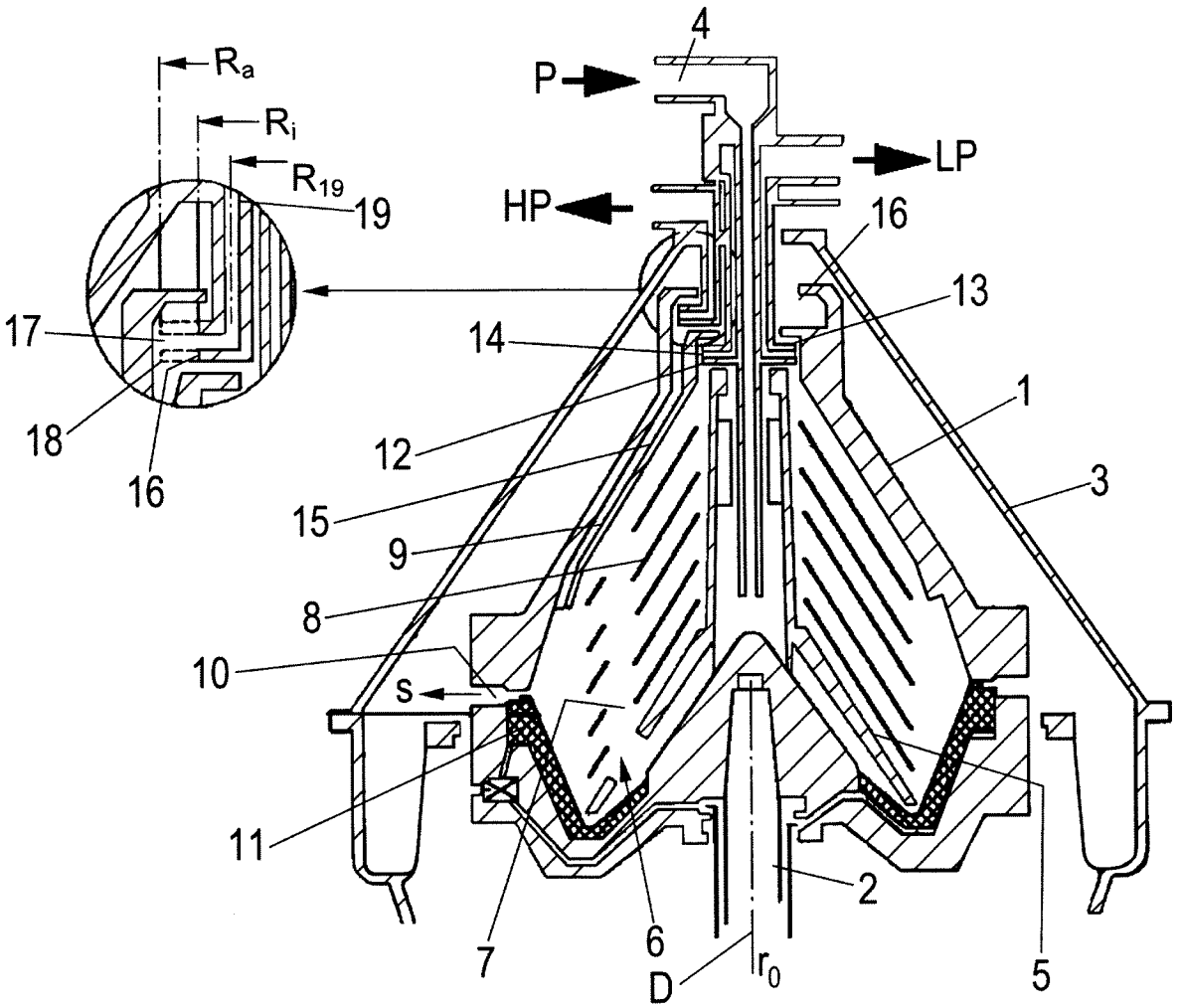
FIG. 1 shows a sectional view of a separator drum with a cap, in accordance with and embodiment of the present disclosure.

FIG. 1 shows a continuously working separator drum 1 which comprises a vertically aligned rotational axis D on the radius $r_0$.

The rotatable separator drum 1 is placed on a rotating spindle 2 which is driven directly or via a belt, for example, and which is rotatably held (not shown). The rotating spindle 2 can be provided with a conical configuration in its upper circumferential region. The separator drum 1 is enclosed by a stationary cap 3 which does not rotate with the drum 1.

In addition to this type of separator construction, constructions are also known in which a bottom drum is quasi "suspended" on an upper rotating spindle. In such a case, the drum will only be held in a rotating oscillating manner at only one of its ends or in connection to one of its axial ends.

The double conical separator drum 1 includes a product feed tube 4 for a product feed P to be centrifuged, to which a distributor 5 is connected, which is provided with at least one or, within the scope of the present disclosure, several outlet openings 6 through which incoming material to be centrifuged or separated can be guided into the interior of the separator drum 1. Also provided is at least one riser 7 of a disk stack 8. Feeding through the spindle 2 from below, for example, is within the scope of the present disclosure.

The separator is constructed such that the outlet openings 6 lie beneath the riser 7 in the disk stack 8 that includes conically shaped separator disks. The conical shape is not shown.

The disk stack 8 is closed off at the top by a separator disk 9 which has an even larger diameter than the disk stack 8.

A separation zone between a lighter liquid phase LP and a heavier liquid phase HP is formed within the disk stack 8 and may, for example, be within the riser 7 in operation during a respective rotation of the drum 1 at a specific radius. An emulsion line or separation line is also known as an E-line.

A solids phase is designated with reference letter S. It is discharged discontinuously through the solids discharge openings 10 which can be opened and closed discontinuously by a piston slide valve 11.

The lighter liquid phase LP, or light phase, will be guided on an inner radius $R_i$ into a separation chamber 12 and from there out of the drum 1 by the first separation element, or separation disk, 13, also known as a gripper.

The separator disk 13 acts like a pump by the dynamic pressure caused by the rotational energy of the liquid. The separator disk 13 may include a valve (not shown) outside of the separator in its downstream discharge, for example, for throttling.

The inlet 14 into the separator disk 13 is disposed on a fixed diameter which is not adjustable.

The heavy liquid phase HP, or heavy phase, on the other hand, flows about the outer circumference of the separator disk 9 through a discharge channel 15 into separator chamber 12 in which a second separator element, or disk, 16 is arranged.

Figure 2:
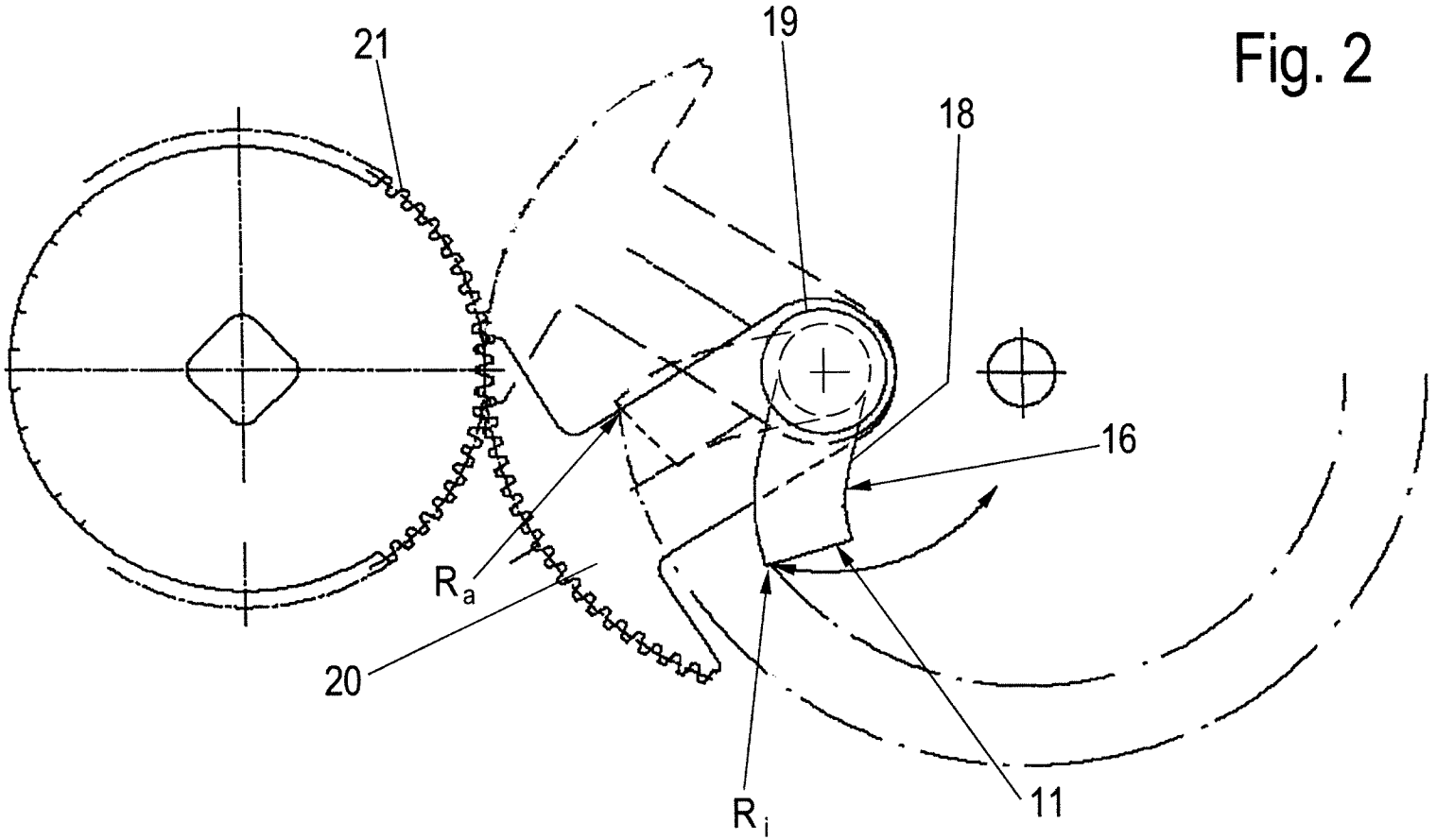
FIG. 2 shows a schematic illustration of the pivoting of a separation element, or disk, to different radii, in accordance with an embodiment of the present disclosure.

This second separator element, or disk, 16 is arranged in such a way that its inlet, or its inlet opening, 17 within the separator chamber 12 is continuously or discontinuously adjustable, for example, see FIG. 2 in this respect, so that at least one inner radius $R_i$ and one outer radius $R_a$ in the drum can be reached.

This can be realized, for example, in such a way that the second separation element, or disk, 16 is arranged as a separation tube which is arranged in an L-shaped manner, as seen in FIG. 1, and includes a first section 18 which is radially aligned in the separation chamber 12 and a second section 19 which is aligned parallel to the rotational axis D and which is guided upwardly out of the rotating system, wherein the second section 19 is rotatable about its longitudinal axis on the radius $R_{19}$. A pivoting of the separator tube, or first section, 18 about the longitudinal rotational axis, or radius, $R_{19}$ (see FIG. 2) allows pivoting the inlet 17 between the longitudinal inner radius $R_i$ having the dashed or wavy line in FIG. 2 and the outer radius $R_a$ having the unbroken line in FIG. 2.

An apparatus for pivoting the separator tube may, for example, be arranged advantageously outside of the separator.

The pivoting can occur in a large variety of ways, that is, by a toothed gearing, a lever mechanism or by a hydraulic or pneumatic drive.

For this purpose, a gearing segment 20 can be arranged on the outside diameter of the tube, for example, which gearing segment 20 will mesh with a drive gearwheel 21 of a gear which is provided upstream with an electric motor (not shown). The drive and gear connection to the second separation element, or disk, 16 can also be realized in other ways, for example, but not shown here.

The three-phase purifier, or separator, with the drum 1 with vertical rotational axis D, as described above, is suitable for separating a large variety of liquid mixtures, such as the separation of water from oil.

Problems with the continuous discharge of the heavier liquid phase will occur during the operation of purifiers if only very small volume flows of this phase need to be processed or if the fraction of the heavier liquid phase relative to the lighter liquid phase is very low, that is, if the fraction of the heavier liquid phase in the incoming product is less than 3%, or, for example, less than 1%, or, for example, 0.5%.

The problems just noted are solved by embodiments of the present disclosure whereby the heavier liquid phase HP is discharged only discontinuously.

Embodiments of the present disclosure include a method and separator such that the adjustable second separation element, or disk, 16 is set in a first step i to such a small inner radius $R_i$ that in an operation it will not immerse into the heavy phase HP. As a result, the heavy phase, that is, water in the separation of water and oil, will accumulate on the outside in drum 1, so that the inner radius $R_i$ up to which the heavier liquid phase HP especially the water, will reach will increase in the drum 1 from the outside to the inside.

When reaching a predetermined inner radius $R_i$, that is, at the time when the heavier liquid phase HP especially the water reaches the inlet 17 of the separation element, or disk, 16 or after the expiration of a predetermined time interval, for example, the inlet 17 of the separation element, or disk, 16 will be adjusted in a second step ii to a larger radius $R_a$ in such a way that it will immerse into the heavier liquid phase HP, so that the heavier liquid phase HP will be discharged from the drum 1. Since a higher amount of heavier liquid phase HP will be discharged than flows into the drum 1 with the incoming product, the maximum radius will further increase radially relative to the rotational axis D to the outside as a result of the discharge up to which the heavier liquid phase HP extends in the drum 1. Once a sufficient quantity of the heavier liquid phase HP has been removed in this manner, the inlet 17 will be pivoted again to a radius, for example, the inner radius $R_i$ of step i, so that the discharge of the heavier liquid phase HP will be interrupted again according to step i.

It is advantageous, in accordance with the present disclosure, to guide only the heavier liquid phase HP, such as water, for example, at first into the drum 1 in an operation during start-up and to supply the actual product to be processed P only when a sufficient water level has been formed.

As a result, heavier liquid phases HP can also be separated from a liquid mixture in which the fraction of the heavier liquid phase HP relative to the lighter phase LP is only very low.

It is advantageous, in accordance with the present disclosure, that energy savings can be achieved in through reduced frictional losses.

The time of the removal of the heavier liquid phase HP can also be controlled by a timer control and can occur in a simple way in fixed intervals, for example, in accordance with the present disclosure.

The point of time of the removal can occur as an alternative and with higher precision by a sensing and/or measuring device, for example, a contact manometer, a flow meter, or a water sensor in the drain.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A method for processing a product by phase separation into two liquid phases and a solids phase, the method steps comprising:

processing the product, the processing occurring in a continuously operating centrifuge arranged as a separator, the separator including a rotatable drum having a vertical rotational axis, a disk stack having risers arranged in the drum, a product feed tube, a first separation disk for discharging a lighter liquid phase, a second separation disk for discharging a heavier liquid phase, solids discharge openings for discharging a solids phase from the drum, and a separation zone formed between the lighter liquid phase and the heavier liquid phase in the separator; and discharging the lighter liquid phase continuously and the heavier liquid phase discontinuously from the drum;

wherein the second separation disk is adjustable and is set to an inner radius such that an inlet opening of the second separation disk will not immerse in the heavier liquid phase during an operation, so that the heavier liquid phase will accumulate outside in the drum, and the radius up to which the heavier liquid phase reaches will rise in the drum from the outside to the inside, and so that when the heavier liquid phase has risen up to the inner radius and has reached the inlet opening, the inlet opening is set to a larger radius, so that the inlet opening immerses in the heavier liquid phase, and the heavier liquid phase will be discharged from the drum; and wherein after the discharge of the heavier liquid phase at such time when the heavier liquid phase reaches the outer radius, the inlet opening is pivoted back to the inner radius, so that the discharge of the heavier liquid phase is interrupted.

2. The method according to claim 1, wherein the heavier liquid phase and the solids phase are discharged discontinuously from the drum at different times.

3. A method for processing a product by phase separation into two liquid phases and a solids phase, the method steps comprising:

processing the product, the processing occurring in a continuously operating centrifuge arranged as a separator, the separator including a rotatable drum having a vertical rotational axis, a disk stack having risers arranged in the drum, a product feed tube, a first separation disk for discharging a lighter liquid phase, a second separation disk for discharging a heavier liquid phase, solids discharge openings for discharging a solids phase from the drum, and a separation zone formed between the lighter liquid phase and the heavier liquid phase in the separator; and discharging the lighter liquid phase continuously and the heavier liquid phase discontinuously from the drum;

wherein for the discontinuous discharge of the heavier liquid phase, the second separation disk is moved to different radii for discharging the heavier liquid phase;

wherein the second separation disk is adjustable and is set to an inner radius such that an inlet opening of the second separation disk will not immerse in the heavier liquid phase during an operation, so that the heavier liquid phase will accumulate outside in the drum, and the radius up to which the heavier liquid phase reaches will rise in the drum from the outside to the inside, and so that when the heavier liquid phase has risen up to the inner radius and has reached the inlet opening, the inlet opening is set to a larger radius, so that the inlet opening immerses in the heavier liquid phase, and the heavier liquid phase will be discharged from the drum; and wherein after the discharge of the heavier liquid phase, the inlet opening is pivoted back to the inner radius, so that the discharge of the heavier liquid phase is interrupted by a setting to the inner radius.

4. The method according to claim 1, wherein a fraction of the heavier liquid phase of the processed product is less than a fraction of the lighter liquid phase.

5. A method for processing a product by phase separation into two liquid phases and a solids phase, the method steps comprising:

processing the product, the processing occurring in a continuously operating centrifuge arranged as a separator, the separator including a rotatable drum having a vertical rotational axis, a disk stack having risers arranged in the drum, a product feed tube, a first separation disk for discharging a lighter liquid phase, a second separation disk for discharging a heavier liquid phase, solids discharge openings for discharging a solids phase from the drum, and a separation zone formed between the lighter liquid phase and the heavier liquid phase in the separator; and discharging the lighter liquid phase continuously and the heavier liquid phase discontinuously from the drum;

wherein for the discontinuous discharge of the heavier liquid phase, the second separation disk is moved to different radii for discharging the heavier liquid phase;

wherein the second separation disk is adjustable and is set to an inner radius such that an inlet opening of the second separation disk will not immerse in the heavier liquid phase during an operation, so that the heavier liquid phase will accumulate outside in the drum, and the radius up to which the heavier liquid phase reaches will rise in the drum from the outside to the inside, and so that when the heavier liquid phase has risen up to the inner radius and has reached the inlet opening, the inlet opening is set to a larger radius, so that the inlet opening immerses in the heavier liquid phase, and the heavier liquid phase will be discharged from the drum; and wherein after the discharge of the heavier liquid phase after a passage of a predetermined period of time, the inlet opening is pivoted back to the inner radius, so that the discharge of the heavier liquid phase is interrupted.

6. The method according to claim 1, wherein the product to be processed is an oil-water-solids mixture.

7. The method according to claim 1, wherein a fraction of the heavier liquid phase in the product to be processed is less than 3%.

8. The method according to claim 1, wherein a fraction of the heavier liquid phase in the product to be processed is less than 1%.

* * * * *